US005158441A

United States Patent [19]

Aid et al.

[11] Patent Number: 5,158,441

[45] Date of Patent: Oct. 27, 1992

[54] PROPORTIONING PUMP

[75] Inventors: James D. Aid, St. Petersburg; Edward R. Lindsay, Dunedin; Robert C. Kusmierczyk, Pinellas Park, all of Fla.

[73] Assignee: Baxter International Inc., Deerfield, Ill.

[21] Appl. No.: 685,584

[22] Filed: Apr. 15, 1991

[51] Int. Cl.[5] ..... F04B 7/06

[52] U.S. Cl. ..... 417/500

[58] Field of Search ..... 417/492, 500

[56] References Cited

U.S. PATENT DOCUMENTS

| | | | |
|---|---|---|---|
| 1,244,160 | 10/1917 | Anderson | 417/500 X |
| 2,059,803 | 11/1936 | Mann | 417/500 X |
| 3,168,872 | 2/1965 | Pinkerton | 417/500 X |
| 3,230,892 | 1/1966 | Burns | 417/492 |
| 3,382,812 | 5/1968 | Smith | 417/500 |
| 4,531,897 | 7/1985 | Orlita | 417/500 |
| 4,863,358 | 9/1989 | Linder | 417/500 |

FOREIGN PATENT DOCUMENTS

| | | | |
|---|---|---|---|
| 1023278 | 1/1958 | Fed. Rep. of Germany | 417/500 |

*Primary Examiner*—Leonard E. Smith

*Attorney, Agent, or Firm*—Charles R. Mattenson; John T. Winburn; Paul C. Flattery

[57] ABSTRACT

A valveless positive displacement pump including a closed end cylinder having two fluid inlet and outlet ports adjacent the closed end. A piston reciprocably and rotatably driven in the cylinder and including a reduced area portion on one free end which communicates cyclically with the inlet and outlet ports to pump fluid through the positive displacement pump. The piston reduced area is a reduced radius portion to minimize air bubble buildup and to minimize fluid volume at the end of the piston stroke. The piston also has a gland area formed in the piston which cyclically communicates with a pair of ports to clean the piston and cylinder and prevent the buildup of solids. The piston and cylinder can be formed from a hard ceramic material for accuracy and wear resistance. The cylinder is closed by a resilient end cap to relieve pressures caused by piston movement when the inlet and outlet ports are closed. The piston is driven by a compliant ball support including a ball and socket biased between the piston and drive shaft to self adjust and compensate for misalignment of the pump. The angle between the drive shaft and the piston is variable to vary the fluid volume and aligned so that the end clearance between the piston and cylinder does not change as the angle is changed.

49 Claims, 3 Drawing Sheets

PROPORTIONING PUMP

FIELD OF THE INVENTION

The present invention relates generally to positive displacement pumps, and more particularly is directed to an improved proportioning pump which is self aligning and has substantially zero backlash.

BACKGROUND OF THE INVENTION

The present invention is directed to positive displacement pumps of the general kind disclosed in U.S. Pat. No. 3,168,872 in the name of Pinkerton. As will be more fully described with respect to FIG. 1, Pinkerton includes a closed end cylinder, a piston mounted and driven in a rotary and reciprocating movement in the cylinders. The cylinder is provided with at least a pair of inlet and outlet ports for the admission and expelling of fluid from the cylinder. The piston, which with the cylinder forms a working chamber, includes a flat duct at least at one free end thereof which sequentially communicates with the inlet and outlet ports as the piston is driven through each cycle to form a valveless positive displacement pump.

In numerous types of fluid systems, the intermixing of fluids must be controlled to a high degree of accuracy. One such system for which the present invention is particularly suited is the intermixing of dialysis concentrates with water to yield dialysate solutions, such as in hemodialysis machines.

Hemodialysis machines are utilized by persons having insufficient or inoperative kidney functions. The machines may be used at a health facility or in the patient's home. The machine attaches to the patient through an extracorporeal circuit of blood tubing to a dialyzer having a pair of chambers separated by a thin semi-permeable membrane. The patient's blood is circulated through one of the chambers. The hemodialysis machine maintains a constant flow of a dialysate through the second chamber. Excess water from the blood is removed by ultrafiltration through the membrane and carried out by the dialysate to a drain.

A typical hemodialysis machine provides a pair of hoses which connect to the dialyzer and include a source of incoming water, a heat exchanger and heater for bringing the water to a required temperature, a source of a dialysate concentrate or concentrates which are introduced into the water in a predetermined concentration and necessary pumps, pressure regulators, a deaerator, flow controllers and regulators. In an acetate dialysis system, only one concentrate is utilized, while in the more common bicarbonate dialysis systems, two concentrates, acidified and bicarbonate are utilized.

Accuracy of proportioning of concentrates in such systems commonly is achieved through the use of some type of fixed stroke proportioning pumps, such as diaphragm type pumps. The fixed stroke diaphragm type pumps are operated at varying frequencies to vary the concentrate volumes, but the diaphragm type pumps are not as accurate as piston type pumps. A second commonly utilized piston type pump however, typically is a water driven fixed ratio pump which is not variable, which does not allow for any flexibility of the fluid intermixing ratios. In numerous types of systems it can be important to adjust the amount of one or more fluids independent of one another, such as the concentration of sodium and bicarbonate via volume of the concentrates in the hemodialysis machines.

The positive displacement pump has the capability of providing the precise mixing levels needed, however, the Pinkerton pump has numerous potential problems when utilized in a hemodialysis machine or similar system. The Pinkerton pump, as will be more fully described with respect to FIG. !, can leak, is noisy, does not self align, can jamb due to the buildup of solids and can be inaccurate due to air bubble buildup on the piston duct or due to end stroke changes in volume.

OBJECTS AND SUMMARY OF THE INVENTION

It is, therefore, a primary object of the present invention to provide an improved positive displacement pump which is quiet and leak resistant.

A further object of the present invention is to provide a positive displacement pump which is adjustable in volume, without changing the end stoke volume.

It is yet another object of the present invention to provide a positive displacement pump which is self cleaning and hence resistant to the buildup of solids.

Another object of the present invention is to provide a positive displacement pump which resists air bubble buildup.

A still further object of the present invention is to provide a positive displacement pump which is self aligning.

A yet further object of the present invention is to provide a positive displacement pump which includes an improved cylinder end cap for relieving both positive and negative pressures caused by piston movement while both ports are closed.

In general, the present invention contemplates a valveless positive displacement pump with a closed end cylinder having fluid inlet and outlet ports adjacent the closed end. A piston is reciprocably and rotatably driven in the cylinder and includes a reduced area portion on one free end which communicates cyclically with the inlet and outlet ports to pump fluid through the positive displacement pump. The piston also has a gland area formed in the piston which cyclically communicates with a pair of ports to clean the piston and cylinder and prevent the buildup of solids. The piston and cylinder preferably are formed from a hard ceramic material for accuracy allowing extremely close tolerances and enhancing wear resistance. The cylinder includes a resilient end cap to relieve pressures caused by the piston displacement and fluid incompressibility when the inlet and outlet ports are closed. The piston is driven by a compliant ball support including a ball and socket biased between the piston and drive shaft to self adjust and compensate for misalignment of the positive displacement pump. The angle between the drive shaft and the piston is adjustable to vary the fluid volume and aligned so that the end clearance between the piston and cylinder does not change as the angle is changed. The piston reduced area portion preferably is a reduced radius portion adjacent the piston end to minimize air bubble buildup and to minimize fluid volume at the end of the piston stroke.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
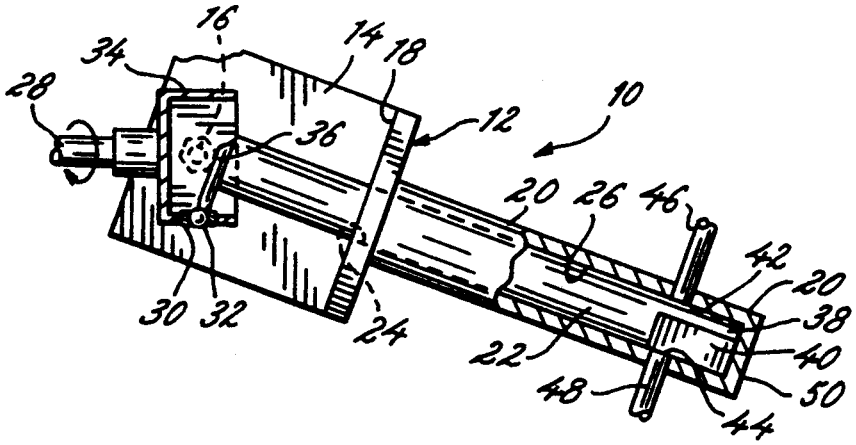
FIG. 1 (PRIOR ART)
FIG. 1 is an enlarged fragmentary top plan view of the prior art Pinkerton pump.

Referring to FIG. 1, the Pinkerton prior art pump is designated generally by the reference numeral 10. FIG. 1 illustrates a top view of the Pinkerton pump 10 showing the basic elements of the positive displacement pump. The positive displacement pump 10 typically is mounted on a horizontal surface (not illustrated) by a bracket 12 pivoted on a leg 14 around a pivot pin 16. A second bracket leg 18 has secured to it the open end of pump cylinder 20.

A piston 22 extends through a bore 24 in the bracket leg 18 into a cylinder interior 26. The piston 22 is connected to a motor drive shaft 28 by a universal ball and socket joint formed by a socket 30 and a ball 32. The socket 30 is formed in a collar or yoke 34 mounted to the shaft 28. The ball 32 is mounted or formed on a drive pin 36, which is secured at a right angle to the end of the piston 22.

The piston 22 includes an outer free end 38 on which is formed a flat cutout or duct portion 40. The cylinder 20 includes at least an inlet port 42 and an outlet port 44, typically connected to respective tubing 46, 48 for the fluid being pumped to flow into and out of the pump 10. As the drive shaft 28 rotates, the piston 22 both reciprocates and rotates in the cylinder interior 26. As the piston 22 cycles, the duct 40 communicates first with the inlet port 42 on the intake portion of the cycle and then with the outlet port 44 on the outlet portion of the cycle. The amount of fluid pumped is controlled by the angle between the axis of the shaft 28 and the axis of the piston 22. The greater the angle, the greater the volume of fluid pumped per cycle.

The pump 10 has many desirable features, such as the lack of separate mechanical gravity ball check valves, ease of volume adjustment and potential accuracy. The pump 10, however, has a number of undesirable features which make the pump 10 less than totally desirable. The ball 32 and socket 30 by definition require some clearance between them, which causes backlash in the pumping cycle between the collar 34 and the piston 22. This causes several problems, including the backlash making a clicking noise as the pump 10 cycles, which can be very disconcerting to a dialysis patient. The noise is very objectionable at angles above about six degrees. Further, small errors in the piston stroke cause relatively large errors in the fluid volume pumped, which become further magnified as the ball and socket wear during use. The errors in volume are very pronounced at small angles between the shaft 28 and the piston 22. Further, the volume of the dead space at the end stroke when the piston 22 is adjacent a closed end 50 of the cylinder 20 varies as the pumping angle and volume is changed, which again can introduce errors in the pumping volume if air bubbles are trapped in the dead space. Trapped air bubbles can expand and contract with the changing pump pressures during each cycle, introducing inaccuracies as high as about three percent.

Also, although the pump 10 does include a scavenging gland orifice (not illustrated) in some embodiments, it is not as efficient as desired. If the fluids contain any salts and they leak to the open end of the cylinder 20, then the pump 10 can become inaccurate or jamb or both. A further fluid volume inaccuracy is caused by the duct 40, which typically is a flat portion cut across the end of the pump 22. Air bubbles have a tendency to build up on the flat duct 40 and are not removed during the pump cycle. The pump 10 when mounted horizontally as suggested in Pinkerton, is not conducive to movement of air bubbles out of the cylinder interior 26.

A further problem causing both noise and inaccuracies is the metal rigid closed cylinder end 50. The piston 22 causes both positive and negative pressures at the two extremes of the pump cycle when the piston 22 closes both the inlet and outlet ports 42 and 44. This causes cavitation on negative pressure and hammering on discharge. Again, this causes noise and fluid volume inaccuracies.

Figure 2:
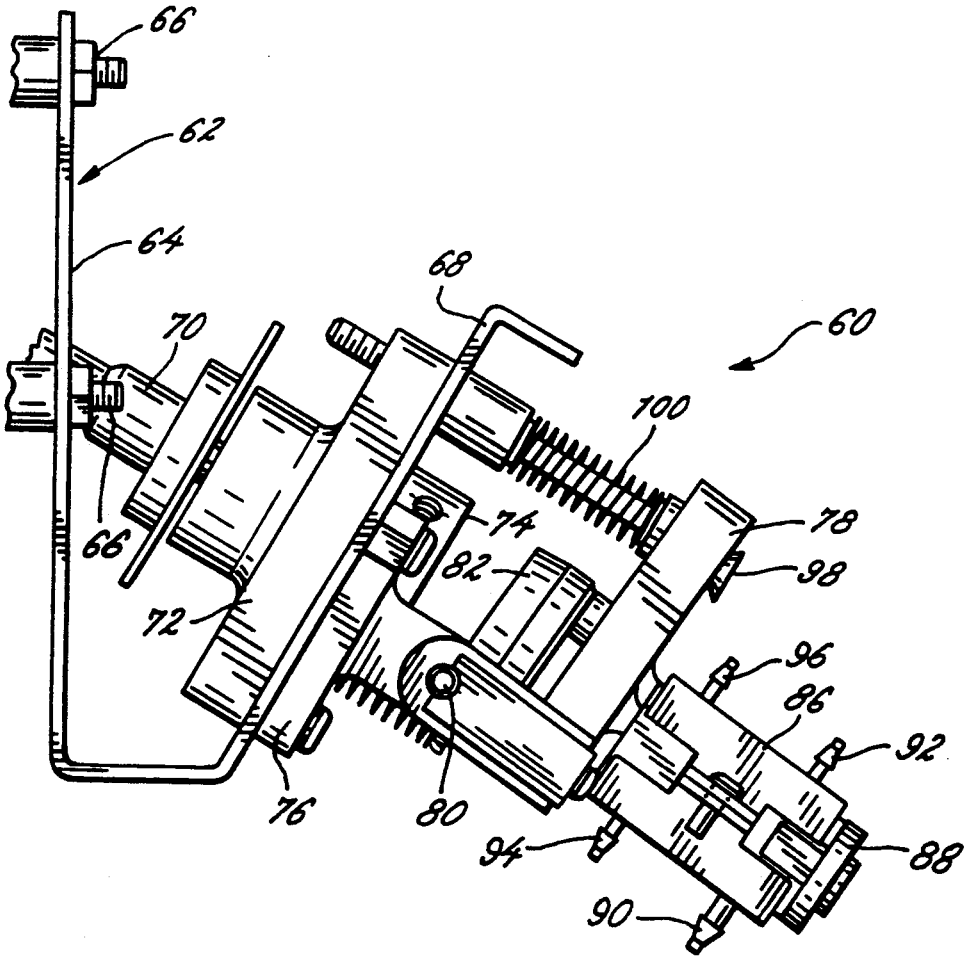
FIG. 2 is a side view of one positive displacement pump embodiment of the present invention.

Referring now to FIG. 2, an improved positive displacement pump of the present invention is designated generally by the reference numeral 60. The pump 60 preferably is mounted at an angle to the horizontal plane, such that entrained air bubbles can migrate upwardly and out of the pump 60. Note, FIG. 2 is a side or vertical view, whereas FIG. 1 is a top or horizontal view. In the example illustrated, the pump 60 is mounted in a support bracket 62. The support bracket 62 includes a first bracket arm 64 which can be mounted to any vertical surface (not illustrated) such as by bolts 66. The pump 60 is mounted to a second bracket arm 68 formed at an angle to the vertical plane. Appropriate bracing brackets are not illustrated.

The pump 60 is driven by a motor (not illustrated), which also can be mounted to the bracket arm 64 and is coupled to a first drive shaft 70. The motor preferably is a stepping motor to provide precise control of the pump speed (cycles per unit time). The mechanical pump valving allows stroke rates or pump cycles of greater than 1000 per minute, where a gravity ball check type of pump is limited to about 100 per minute. The drive shaft 70 is coupled to a shaft and zero backlash bearing housing 72, mounted to the bracket arm 68, which in turn drives a pump drive cylinder 74.

A pump support bracket 76 is mounted to the bracket arm 68 adjacent the drive cylinder 74. A pump head 78 is pivotably connected to the support bracket 76 by a pair of opposed pins 80 (one of which is shown). A piston holder 82 is rotatably mounted in the pump head 78. A pump cylinder 84 (FIG. 3) is mounted in a cylinder housing 86, which pump cylinder 84 includes an end cap 88, as will later be described.

The cylinder housing 86 includes a pair of inlet/outlet fittings 90, 92. Either fitting 90, 92 can be coupled to the inlet or outlet port, since the pump 60 is reversible, however in the configuration illustrated, fitting 90 is the fluid inlet and fitting 92 is the fluid outlet. The cylinder housing 86 also includes a pair of gland fittings 94, 96, one or both of which can be coupled to a negative or positive pressure source or a source of rinse fluid (not illustrated).

The volume of fluid pumped on each cycle is controlled by the angle of the pump 60 to the drive shaft 70, as before described. This angle is adjusted by turning an adjustment screw 98 which is rotatably mounted in the pump head 78 and threadedly engaged in the bracket arm 68. The pump head 78 is biased away from the bracket arm 68 by a spring 100.

Figure 4:
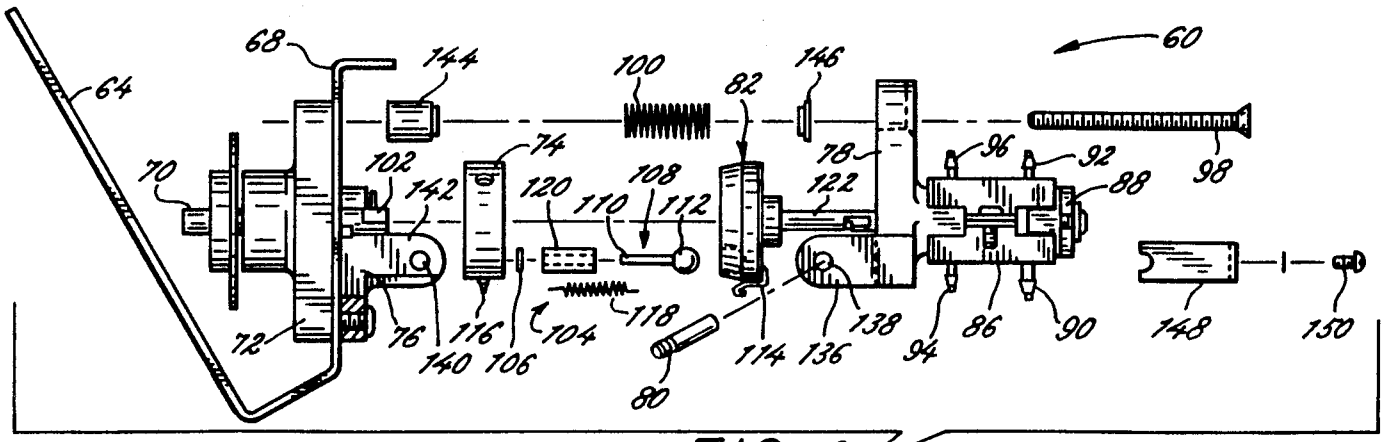
FIG. 4 is an exploded assembly view of the positive displacement pump embodiment of FIG. 2.
Figure 3:
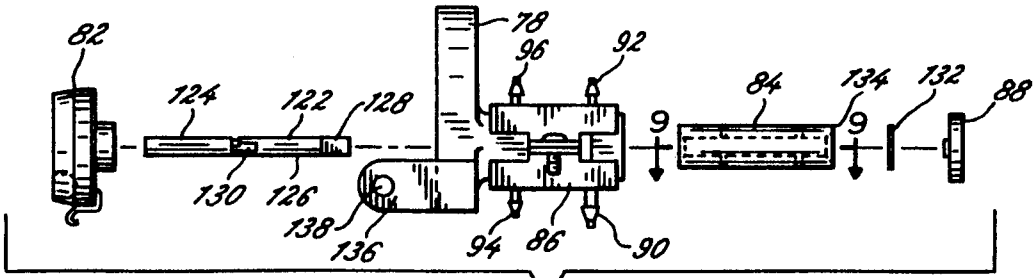
FIG. 3 is an exploded assembly view of the piston and cylinder assembly of the present invention.

Details of the assembly of the pump 60 are best illustrated in FIGS. 3 and 4. The drive shaft 70 is coupled to or is formed with a drive cylinder drive shaft 102 in the housing 72, which is coupled to and rotates the drive cylinder 74. The drive cylinder 74 is coupled to the piston holder 82 by a compliant ball support assembly 104. The ball support assembly 104 compensates for assembly and operating misalignment of the pump 60. The ball support assembly 104 includes a wear disc or pad 106, formed from a material such as ultra high molecular weight polyethylene. The pad 106 is inserted into a recess or socket (not illustrated) in a periphery of the drive cylinder 74. A drive cylinder ball shaft 108 includes a shaft portion 110 and a ball 112. The ball 112 fits into a socket (not illustrated) in a periphery of the piston holder 82. The piston holder 82 also includes a spring hook 114 connected to the periphery thereof.

The drive cylinder 74 includes a spring pin 116 mounted in the side thereof and a ball and socket spring 118 is connected between the spring hook 114 and the spring pin 116 to connect the ball support assembly 104. The spring 118 has a tension which exceeds the suction pressures exerted by the pump induced loads to prevent backlash and noise. The ball support assembly 104 preferably includes a compliant tube 120 into which is inserted the shaft 110, formed from flexible material such as pvc tubing. The ball shaft 108 and the tube 120 further automatically compensate for assembly and operating misalignment of the pump 60. The ball support assembly 104 both transmits torque as well as allows lateral movement, which prevents noise and induced misalignment forces or loads that can cause excessive wear.

Construction misalignment can be caused by the piston holder 82 being adjusted out of alignment by the drive cylinder 74 when the pump displacement is adjusted. There are three type of essentially unavoidable mechanical misalignments. First, the axis of the drive cylinder 74 will never be perfectly aligned with the axis of the piston holder 82. Secondly, the pivot point of the pump head 78 on the pins 80 can be offset from the position of the ball 112 at the top dead center of the pump stroke in the vertical direction and thirdly, it can be offset in the horizontal direction. Horizontal misalignment can be caused when the drive cylinder 74 is adjusted on the shaft 102 to provide the desired minimal end clearance or dead space.

As the drive cylinder 74 rotates, the piston holder 82 also rotates through the coupling of the ball support assembly 104. The ball support assembly 104 thus provides a number of advantages over the mechanically fixed ball and socket of Pinkerton, including substantially no backlash and compensation for misalignments. The shaft 110 has a radius on its free end bearing against the wear disc 106 to minimize wear on the wear disc 106 caused by misalignment of the pump 60. The spring 118 couples the piston holder 82 to the ball shaft 108 with sufficient preloaded force to prevent backlash. The spring 118 has sufficient preloaded force to overcome the internal suction forces in the pump 60 and firmly holds the drive cylinder 74 to the piston holder 82. The ball support assembly 104 provides two degrees of freedom to prevent stress on the pump 60 without inducing additional misalignment of the pump 60.

Figure 7:
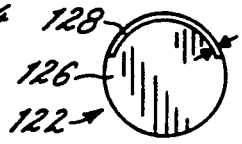
FIG. 7 is an end view of the piston of FIG. 6.

The piston holder 82 includes a piston 122 mounted at a first end 124 in the piston holder 82. The piston 122 includes a second free end 126 on Which is formed a reduced ar ®a portion 128 to act as a fluid duct similar to the Pinkerton duct 40. The reduced area portion 128 will be discussed in further detail with respect to FIGS. 5, 6 and 7. The piston 122 also includes a reduced area gland portion 130 formed thereon, which will be further discussed with respect to FIGS. 5, 6 and 8.

The pump cylinder 84 includes a resilient diaphragm 132 mounted onto an end 134 of the pump cylinder 84 by the end cap 88. The pump head 78 includes a pair of opposed arms 136 (only one of which is illustrated) having an aperture 138 into which the pins 80 are inserted. The pins 80 also are inserted through matching apertures 140 in matching opposed arms 142 (only one of which is illustrated) to mount the pump head 78 on the support bracket 76 and provide the pivotable mounting for the pump 60.

The adjustment screw 98 can include a spring spacer 144 and a washer 146 if desired. The pins 80 can be secured by a pair of retainer brackets 148 (only one of which is illustrated) mounted to and over the arms 136, such as by screws 150. The offset pivot point alignment provided by the pins 80 is across the center of the ball 112 at its lowest position. This alignment maintains a constant dead space between the piston end 126 and the cylinder end 134 as the angle of the pump 60 is varied. This minimizes the top dead center end clearance to help ensure that air bubbles are not trapped in the pump head, which enhances priming and the pump's accuracy.

Figure 5:
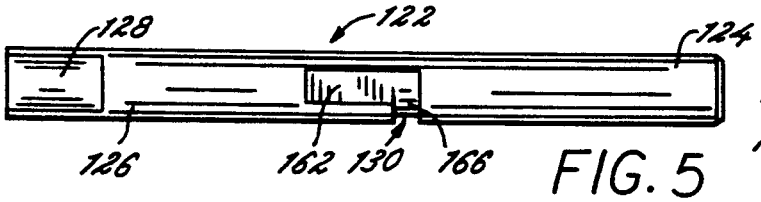
FIG. 5 is one side view of a piston embodiment of the present invention.
Figure 6:
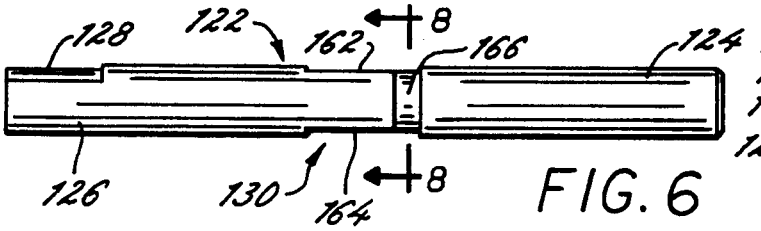
FIG. 6 is another side view of the piston of FIG. 5.
Figure 8:
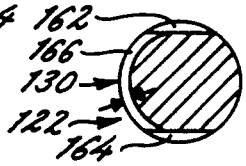
FIG. 8 is a section of the piston of FIG. 6 taken along the line 8—8 therein.

Referring now to FIGS. 5, 6, and 8, the details of the piston duct 128 are best illustrated. Instead of a substantially flat end cut duct like the duct 40 of Pinkerton, the duct 128 is an arcuate reduced area portion which compared to the duct 40 is mostly filled in. The duct 128 provides a significant advantage, because it assists in priming of the pump 60. By substantially filling the duct in, air bubbles are not as likely to accumulate. In tests between the flat type of duct 40 and the duct 128, air bubbles were significantly reduced. When air bubbles accumulate on the piston duct, they expand and contract during the pump cycle causing inaccurate pumping and hindering priming.

Figure 9:
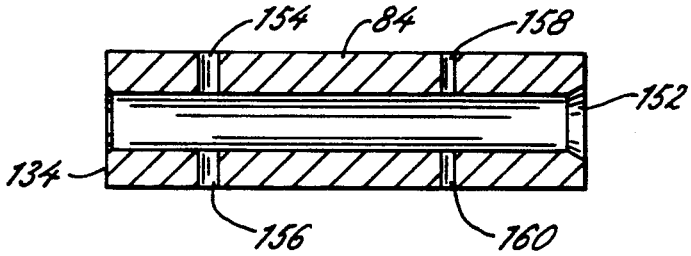
FIG. 9 is a side sectional view of one embodiment of the pump cylinder of the present invention.

The pump cylinder 84 (FIG. 9) includes an open end 152 into which the piston 122 is inserted. As seen in FIG. 2, this end is tilted upwardly which also facilitates the movement of entrained air upward and out of the pump cylinder 84. Since the closed end of the pump cylinder 84 is titled downward with the discharge port at the highest point, air bubbles will tend to accumulate in proximity of the discharge port and will tend to exit with each discharge stroke.

The operation of the piston gland 130 is best illustrated with respect to FIGS. 5, 6, 8 and 9. The pump cylinder 84 includes a pair of inlet and outlet ports 154, 156 through which the piston 122 pumps the fluid and which are connected to the fittings 90 and 92, employing an appropriate static seal between them. The pump cylinder 84 also includes a pair of gland ports 158, 160 which are coupled to the fittings 94, 96. In non-dialysis applications, if the pump 60 is pumping non-salt or non-abrasive fluids, then in some cases the gland can be eliminated.

In the case however, of fluids which will evaporate and deposit solids, such as dialysis fluids, then the glands are necessary since fluid potentially can seep due to capillary forces between the piston 122 and the pump cylinder 84, which can dry and jamb the pump when it nears or reaches the open end 152. To prevent this the gland structure 130, 158 and 160 is provided. The gland area 130 includes two longitudinal areas 162 and 164 on opposite sides of the piston 122 joined by a radial reduced area 166.

As the piston 122 simultaneously rotates and reciprocates, the areas 162, 164 will line up with the ports 158 and 160 twice each pumping cycle. A rinse fluid can be connected to the ports 158 and 160 to flush the end of the cylinder housing 84 and the piston 122. A negative pressure also can be connected to the ports 158 and 160 to suck any seepage fluid or air from the open end 152 away from the pump 60. By connecting the gland 130 to the ports twice a cycle, air as the less dense fluid will quickly be removed, while the denser fluid such as water will not be drawn to the ports 158 and 160. One dialysis use of the pump 60, includes one or both of the acidic or bicarbonate proportioners coupled to the deaerator reservoir. It is desired to retain water while the removal of air is desired. By modulating this air and water mixture with the gland opening and closing, the air will quickly be drawn off, while the water having a greater inertia will not.

The number of times the gland 130 is opened is not critical, but the control by valving of the gland operation is important. A rinsing fluid can be alternated with the negative pressure when desired. The open orifice disclosed by Pinkerton does not accurately meter fluid flow and if it is too small it can be clogged by debris. The gland valving also is self-regulating since the gland will be opened more frequently as the pumping speed is increased. The number of openings and closings of the gland varies directly with pump speed; however, the total ratio of open time remains constant independent of the pump speed. Both the cylinder housing 84 and the piston 122 preferably are formed from a hard wear resistant material, such as alumina ceramic. The cylinder housing 84 and the piston 122 also preferably are formed as mated pairs for close tolerance to further enhance accuracy.

Figure 10A:
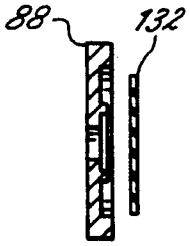
FIGS. 10A-C are side sectional views of multipiece end cap embodiments of the present invention.
Figure 10B:
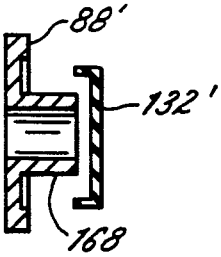
Figure 10C:
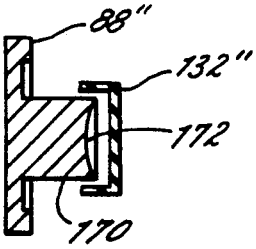

When the piston 122 is near either end of the pumping stroke, both the ports 154 and 156 are closed to prevent potential reverse flow. At this point, the piston 122 still is moving to complete the pump stroke, further creating either suction or compression in the chamber and against the end cap 88. Unlike the rigid fixed cylinder end 50 of Pinkerton, the end cap 88 includes a diaphragm 132 to alleviate these sudden positive and negative pressures. Referring to FIGS. 10A–10C, several embodiments of end caps 88 are illustrated having a separate resilient diaphragm 132. As illustrated in FIGS. 3 and 10A, the end cap 88 can include the separate diaphragm 132, which is secured to the end 152 of the pump cylinder 84 by the end cap 88.

The diaphragm 132 flexes into or out of the pump cylinder 84 when the end stroke large pressure differentials occur. Without the diaphragm 132, these large pressure spikes cause excess loading on the pump 60 which decreases the pump life and also creates annoying noises in the pump. The diaphragm material, such as Teflon, is selected to only slightly deform during normal operating pressures so as not to significantly effect the pump accuracy. The diaphragm deforms significantly more during the pressure spikes. The volume of a cavity in the end cap can be utilized to absorb the pressure spike by compressing the air in the cavity. The stress on the diaphragm material cannot exceed its elastic limits or the accuracy of the pump volume will be affected.

FIG. 10B illustrates a second end cap 88', which has a diaphragm 132' which fits over the outside of a cylindrical portion 168 of the end cap 88'. The cylindrical portion 168 encloses a significant volume of air, which can be plugged as desired. Another separate end cap embodiment 88'' includes a diaphragm 132'' mounted over a cylindrical post 170 having a recess or depression 172 formed in the outer end to cushion the diaphragm 132''. The post 170 fits into the pump cylinder 84 with the diaphragm 132'' over the recess 172 to provide the pump cushioning.

Figure 11A:
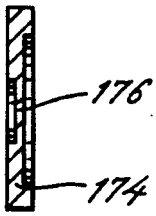
FIGS. 11A and 11B are side sectional views of integral end cap embodiments of the present invention.
Figure 11B:
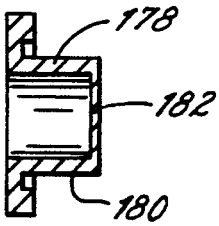

The end caps also can be formed as integral units as illustrated in FIGS. 11A and B. A one piece end cap 174 is illustrated in FIG. 11A. The end cap 174 is formed of a first thickness which will not substantially deform, but includes a central reduced thickness resilient area 176, which will act as the diaphragm. A second unitary end cap 178 is illustrated in FIG. 11B. Similar to the end cap 88', the end cap 178 has a cylindrical hollow position 180 and has a thinner resilient end portion 182, which will act as the diaphragm like the area 176.

The pump 60 as described can be utilized for the accurate intermixing of fluids, such as dialysate solutions and can be utilized to adjust the levels of both sodium and bicarbonate independently of one another. The mixing precision and system dynamics can be further enhanced by computer monitored feedback control. The pump 60 can pump slurries in industrial applications, can accommodate the grit and abrasion of the bicarbonate solutions and also can pump dry gasses. The flexibility results from the piston and pump cylinder materials and construction and close clearances which also eliminate the need for dynamic lip or piston lip seals in the pump 60. The ceramic materials allow a diametric clearance on the order of one half of a ten thousandth of an inch. The alignment, which fixes the end space or clearance so it does not vary also allows the pump 60 to be adjusted for a minimal end clearance which aids in the pump priming by reducing the dead space volume which along with the filled piston end reduces the amount of air expansion and cavitation.

The design of the gland 130 provides a stabilized and regulated flow through the gland 130. This is a desirable pump feature to enable the suction force to function as a relatively constant negative or positive pressure. The required cycling of the gland 130 causes the scavenging flow to move intermittently. The flow into the gland 130 can be air, water or any combination thereof. The axial piston position during a stroke does not affect the opening of the gland 130, which is solely controlled by the rotating position. The gland 130 can receive air seepage from the open end of the pump 60 or can receive fluid seepage from the closed end. By use of appropriate external valves, the flow can be up or down through the gland 130 with positive or negative pressure applied. Also, depending upon the application, negative pressure can be applied to only one of the top or the bottom gland port. This again will provide a different flow through the gland 130. Suction only from the top is desirable if a failure in the water treatment system could allow hard water to pass through the gland 130 in a dialysis system. If the concentrate being pumped is bicarbonate then seepage mixed with hard water can cause precipitate to form. This can cause the pump 60 to freeze up. Thus, by employing suction only, the risk of freeze up is eliminated.

We claim as our invention:

1. A valveless reversible positive displacement pump, comprising:

a closed end cylinder including two fluid port means for allowing fluid to flow into and out of said cylinder adjacent said closed end;

piston means reciprocably and rotatably drivable in said cylinder, said piston means includes a reduced area portion on one free end thereof adjacent said cylinder closed end, which portion alternately communicates with each of said fluid port means as said piston means are reciprocably and rotatably driven to draw fluid in one fluid port means and expel it through the second fluid port means; and gland means formed in said piston means spaced form said reduced area portion and said two fluid port means which gland means communicate with at least one gland port means in said cylinder as said piston means are reciprocably and rotatably driven in said cylinder.

2. The pump as defined in claim 1 including a pair of substantially opposed gland port means and said gland means are formed to communicate with said gland port means in a cyclic manner as said piston means are reciprocably and rotatably driven.

3. The pump as defined in claim 2 wherein said gland means communicate with said gland port means twice per cycle of said piston means.

4. The pump as defined in claim 1 wherein said piston means are formed from a hard ceramic material.

5. The pump as defined in claim 1 including end cap means forming at least a portion of said cylinder closed end for relieving positive and negative pressures caused by said piston means when both said two fluid port means are closed by said piston means without introducing significant error in pumping accuracy.

6. The pump as defined in claim 1 including said piston means being driven by compliant ball support means for self adjusting and compensating for assembly and operating misalignment of said piston means.

7 The pump as defined in claim i including said piston means being driven by ball and socket means which are separate from but biased together between said drive shaft means and said piston means.

8. The pump as defined in claim 1 wherein said piston means are adjustable to vary the fluid volume of each piston means cycle without changing the end clearance of said piston means with said closed end cylinder.

9. The pump as defined in claim 1 wherein said piston means reduced end portion is formed on a substantially round piston end and is formed by a reduced radius portion on said piston end to prevent buildup of air bubbles and to minimize the fluid volume at the piston means end stroke adjacent said closed cylinder end.

10. The pump as defined in claim 1 wherein said closed end cylinder is formed from a hard ceramic material.

11. The pump as defined in claim 1 including means for applying at least one of negative or positive pressure to said gland port means.

12. The pump as defined in claim 1 including said cylinder tilted at an angle with said closed end down to assist in air removal from said cylinder.

13. The pump as defined in claim 1 including said gland port means coupled to deaerator means in a dialysis system.

14. The pump as defined in claim 1 including means for stabilizing the fluid flow through said gland means.

15. The pump as defined in claim 1 including end cap means forming at least a portion of said cylinder closed end for relieving positive and negative pressures caused by said piston means when both said two fluid port means are closed by said piston means without introducing significant error in pumping accuracy;

said piston means being driven by compliant ball support means for self adjusting and compensating for assembly and operating misalignment of said piston means, including ball and socket means which are separate from but biased together between said drive shaft means and said piston means; and including a pair of substantially opposed gland port means and said gland means are formed to communicate with said gland port means in a cyclic manner as said piston means are reciprocably and rotatably driven.

16. A valveless reversible positive displacement pump, comprising:

a closed end cylinder including two fluid port means for allowing fluid to flow into and out of said cylinder adjacent said closed end;

piston means reciprocably and rotatably drivable in said cylinder, said piston means including a reduced area portion on one free end thereof adjacent said cylinder closed end, which portion alternately communicates with each of said fluid port means as said piston means are reciprocably and rotatably driven to draw fluid in one fluid port means and expel it through the second fluid port means; and end cap means forming at least a portion of said cylinder closed end for relieving positive and negative pressures caused by said piston means when both said two fluid port means are closed by said piston means without introducing significant error in pumping accuracy.

17. The pump as defined in claim 16 wherein said end cap means are formed integrally with said closed end cylinder.

18. The pump as defined in claim 16 wherein said end cap means are formed from a resilient material separate from said closed end cylinder.

19. The pump as defined in claim 16 wherein said piston means are formed from a hard ceramic material.

20. The pump as defined in claim 16 wherein said piston means are adjustable to vary the fluid volume of each piston means cycle without changing the end clearance of said piston means with said closed end cylinder.

21. The pump as defined in claim 16 wherein said piston means reduced end portion is formed on a substantially round piston end and is formed by a reduced radius portion on said piston end to prevent buildup of air bubbles and to minimize the fluid volume at the piston means end stroke adjacent said closed cylinder end.

22. The pump as defined in claim 16 wherein said closed end cylinder is formed from a hard ceramic material.

23. The pump as defined in claim 16 including gland means formed in said piston means spaced from said reduced area portion and said two fluid port means which gland means communicate with at least one negative pressure gland port means in said cylinder as said piston means are reciprocably and rotatably driven in said cylinder.

24. The pump as defined in claim 23 including said gland port means coupled to deaerator means in a dialysis system.

25. The pump as defined in claim 16 including said piston means being driven by compliant ball support means for self adjusting and compensating for assembly and operating misalignment of said piston means.

26. The pump as defined in claim 16 including said piston means being driven by ball and socket means which are separate from but biased together between said drive shaft means and said piston means.

27. The pump as defined in claim 16 including gland means formed in said piston means spaced from said reduced area portion and said two fluid port means which gland means communicate with at least one gland port means in said cylinder as said piston means are reciprocably and rotatably driven in said cylinder;

said piston means being driven by compliant ball support means for self adjusting and compensating for assembly and operating misalignment of said piston means, including ball and socket means which are separate from but biased together between said drive shaft means and said piston means; and said piston means are formed from a hard ceramic material.

28. A valveless reversible positive displacement pump, comprising:

a closed end cylinder including two fluid port means for allowing fluid to flow into and out of said cylinder adjacent said closed end;

piston means reciprocably and rotatably drivable in said cylinder, said piston means including a reduced area portion on one free end thereof adjacent said cylinder closed end, which portion alternately communicates with each of said fluid port means as said piston means are reciprocably and rotatably driven to draw fluid in one fluid port means and expel it through the second fluid port means; and said piston means being driven by compliant ball support means for self adjusting and compensating for assembly and operating misalignment of said piston means.

29. The pump as defined in claim 28 wherein said compliant ball support means include a resilient wear disc bearing against one end of a drive cylinder ball shaft having a ball on the opposite end, said shaft enclosed in a resilient sleeve and said ball mounted in a periphery of said piston means.

30. The pump as defined in claim 29 wherein said disc and shaft are biased against a periphery of piston means drive cylinder means coupled to a drive shaft and said ball is biased against said periphery of said piston means.

31. The pump as defined in claim 28 wherein said piston means are formed from a hard ceramic material.

32. The pump as defined in claim 28 wherein said piston means are adjustable to vary the fluid volume of each piston means cycle without changing the end clearance of said piston means with said closed end cylinder.

33. The pump as defined in claim 28 wherein said piston means reduced end portion is formed on a substantially round piston end and is formed by a reduced radius portion on said piston end to prevent buildup of air bubbles and to minimize the fluid volume at the piston means end stroke adjacent said closed cylinder end.

34. The pump as defined in claim 28 wherein said closed end cylinder is formed from a hard ceramic material.

35. The pump as defined in claim 28 including gland means formed in said piston means spaced from said reduced area portion and said two fluid port means which gland means communicate with at least one gland port means in said cylinder as said piston means are reciprocably and rotatably driven in said cylinder.

36. The pump as defined in claim 35 including said gland port means coupled to deaerator means in a dialysis system.

37. The pump as defined in claim 28 including end cap means forming at least a portion of said cylinder closed end for relieving positive and negative pressures caused by said piston means when both said two fluid port means are closed by said piston means.

38. The pump as defined in claim 28 including said piston means being driven by ball and socket means which are separate from but biased together between said drive shaft means and said piston means.

39. The pump as defined in claim 28 including gland means formed in said piston means spaced from said reduced area portion and said two fluid port means which gland means communicate with at least one gland port means in said cylinder as said piston means are reciprocably and rotatably driven in said cylinder; and said piston means being driven by compliant ball support means for self adjusting and compensating for assembly and operating misalignment of said piston means, including ball and socket means which are separate from but biased together between said drive shaft means and said piston means

40. A valveless reversible positive displacement pump, comprising:

a closed end cylinder including two port means for allowing fluid to flow into and out of said cylinder adjacent said closed end;

piston means reciprocably and rotatably drivable in said cylinder, said piston means including a reduced area portion on one free end, thereof adjacent said cylinder closed end, which portion alternately communicates with end of said fluid port means as said piston means are reciprocably and rotatably driven to draw fluid in one fluid port means and expel it through the second fluid port means; and said piston means being driven by ball and socket means which are separate from but biased together between said drive shaft means and said piston means.

41. The pump means as defined in claim 40 wherein said ball and socket means include compliant ball support means for self adjusting and compensating for assembly and operating misalignment of said piston means.

42. The pump means as defined in claim 40 including gland means formed in said piston means spaced from said reduced area portion and said two fluid port means which gland means communicate with at least one negative pressure gland port means in said cylinder as said piston means are reciprocably and rotatably driven in said cylinder.

43. The pump as defined in claim 42 including said gland port means coupled to deaerator means in a dialysis system.

44. The pump means as defined in claim 40 including end cap means forming at least a portion of said cylinder closed end for relieving positive and negative pressures caused by said piston means when both said two fluid port means are closed by said piston means.

45. The pump as defined in claim 40 wherein said piston means are formed from a hard ceramic material.

46. The pump means as defined in claim 40 wherein said ball and socket means include compliant ball support means for self adjusting and compensating for assembly and operating misalignment of said piston means;

gland means formed in said piston means spaced from said reduced area portion and said two fluid port means which gland means communicate with at least one negative pressure gland port means in said cylinder as said piston means are reciprocably and rotatably driven in said cylinder;

end cap means forming at least a portion of said cylinder closed end for relieving positive and negative pressures caused by said piston means when both said two fluid port means are closed by said piston means; and said piston means are adjustable to vary the fluid volume of each piston means cycle without changing the end clearance of said piston means with said closed end cylinder.

47. The pump as defined in claim 40 wherein said piston means are adjustable to vary the fluid volume of each piston means cycle without changing the end clearance of said piston means with said closed end cylinder.

48. The pump as defined in claim 40 wherein said piston means reduced end portion is formed on a substantially round piston end and is formed by a reduced radius portion on said piston end to prevent buildup of air bubbles and to minimize the fluid volume at the piston means end stroke adjacent said closed cylinder end.

49. The pump as defined in claim 40 wherein said closed end cylinder is formed from a hard ceramic material.

* * * * *